United States Patent [19]

Peters

[11] Patent Number: 4,920,676

[45] Date of Patent: May 1, 1990

[54] PISTOL WITH AN INTERCHANGEABLE BARREL

[76] Inventor: Franz-Josef Peters, Senefelder Str. 19, D-4790 Paderborn, Fed. Rep. of Germany

[21] Appl. No.: 214,384

[22] Filed: Jul. 1, 1988

[30] Foreign Application Priority Data

Jul. 2, 1987 [DE] Fed. Rep. of Germany ... 8709136[U]

[51] Int. Cl.[5] ..... F41C 3/00; F41C 21/22; F41C 11/00

[52] U.S. Cl. ..... 42/25; 89/163

[58] Field of Search ..... 42/25; 89/163, 196

[56] References Cited

U.S. PATENT DOCUMENTS 808,003 12/1905 Browning .
2,465,553 3/1949 Robinson, Jr. .
3,680,240 8/1972 Barr et al. .
3,791,060 2/1974 Weaver .
4,358,987 11/1982 Wilhelm .

*Primary Examiner*—Charles T. Jordan
*Assistant Examiner*—Richard W. Wendtland
*Attorney, Agent, or Firm*—Foley & Lardner, Schwartz, Jeffery, Schwaab, Mack, Blumenthal & Evans

[57] ABSTRACT

A pistol includes a barrel for holding a cartridge. A breech is movably mounted on a grip piece and movable relative to the barrel. The breech has opposed first and second claws resiliently biased for supporting a cartridge base. An ejector is received by the breech so that in response to movement of the breech relative to the barrel, the second claw slides from the cartridge base and the first claw engages the cartridge base for pivoting the cartridge for ejection from the barrel. An interchangeable barrel release mechanism lowers an end of the barrel in response to rearward movement of the breech relative to the barrel.

12 Claims, 3 Drawing Sheets

PISTOL WITH AN INTERCHANGEABLE BARREL

BACKGROUND OF THE INVENTION

The invention relates to a pistol with an interchangeable barrel to be converted to different projectile calibers, so that ammunition with a smaller caliber can be used, for example for training purposes.

In conventional pistols of this type, the breech surface confronting the cartridge base, that is to say the so-called concussion base, has a shallow, essentially circular recess for receiving the cartridge base. This recess is limited, on one side, by a pull-out claw, by means of which the cartridge case is grasped at the cartridge base and pulled out of the barrel when the breech is moved back relative to the barrel, after the locking of the breech has been cancelled. The grip piece or housing of the pistol is equipped, on that side of the breech located opposite the pull-out claw, with a rigid ejector which, during the rearward movement of the breech and of the cartridge case, butts against the cartridge base, so that the cartridge case is ejected on the side on which the pull-out claw is located.

In this conventional construction, the breech of the pistol is therefore specially adapted to the dimensions of the cartridge base of the ammunition used. The disadvantage of this is that, despite the exchangeability of the barrel, only ammunition with a uniform cartridge base can be used. Only the projectile caliber and the shape of the cartridge case can consequently be varied.

In many conventional pistols, for example in Colt pistols, the breech is released by means of two links which are arranged on both sides of the rear end of the barrel and which are fastened at their lower end in an articulated manner to a bolt on the grip piece of the pistol and at their upper end in an articulated manner to the barrel. When the barrel moves backwards as a result of the recoil after a shot has been fired, these links bring about a semicircular rearward and downward movement of the rear end of the barrel, while the breech moves in a straight line in appropriate guides of the grip piece. Locking grooves and locking projections arranged on the top of the barrel come out of corresponding grooves and projections of the breech, so that the locking between the barrel and breech is cancelled.

The disadvantage of this construction, especially in pistols with an interchangeable barrel, is that it is relatively complicated to change the barrel. Another disadvantage is that, as a result of the action of the links, a certain pivoting of the barrel occurs even before the projectile has left the barrel, and the aiming accuracy of the weapon is therefore impaired.

SUMMARY OF THE INVENTION

An object of the invention is to provide a pistol with an interchangeable barrel, which can be converted in a simple way to ammunition with different cartridge-base dimensions, without the breech having to be exchanged or the functioning of the ejection mechanism impaired.

According to the invention, the breech has a smooth concussion base, and the cartridge base is held only by the pull-out claw and by a holding claw arranged on the opposite side. Adaptation to different cartridge base diameters is therefore possible as a result of an appropriate elastic resilience of the pull-out claw and the holding claw. The holding claw is designed so that it releases the cartridge base as soon as the ejector acts on the cartridge base.

Another object of the invention is to provide a release mechanism which makes it possible to convert a pistol having a grip piece adapted to the above-described Colt system in such a way that the barrel is not connected to the grip piece via links. It thereby becomes simpler to exchange the barrel.

In the release system according to the invention, the barrel first moves back together with the breech in a straight line. Even with varying properties of the ammunition and different initial projectile velocities, this guarantees that the lowering movement of the rear end of the barrel occurs only when the projectile has left the barrel, thus ensuring increased aiming accuracy.

The release system is particularly expedient for pistols with an interchangeable barrel, but can also be used, independently to increase the aiming accuracy.

In accomplishing the foregoing objects, there has been provided according to one aspect of the present invention a pistol with an interchangeable barrel comprising a barrel for holding a cartridge, a breech movably mounted on a grip piece and movable relative to the barrel, the breech having first and second claws for supporting a cartridge base. An ejector is received by the breech and in response to movement of the breech relative to the barrel, the second claw slides from the cartridge base and the first claw retains the cartridge base thus pivoting the cartridge for ejection thereof.

A release mechanism comprises an extension of the barrel including a control face for mating engagement with an extension of the breech having a recess for receiving the barrel extension and a ramp face for mating engagement with the control face.

The foregoing and other aspects will become apparent from the following detailed description of the invention when considered in conjunction with the accompanying drawings.

DETAILED DESCRIPTION OF THE PREFERRED EMBODIMENTS

Figure 1:
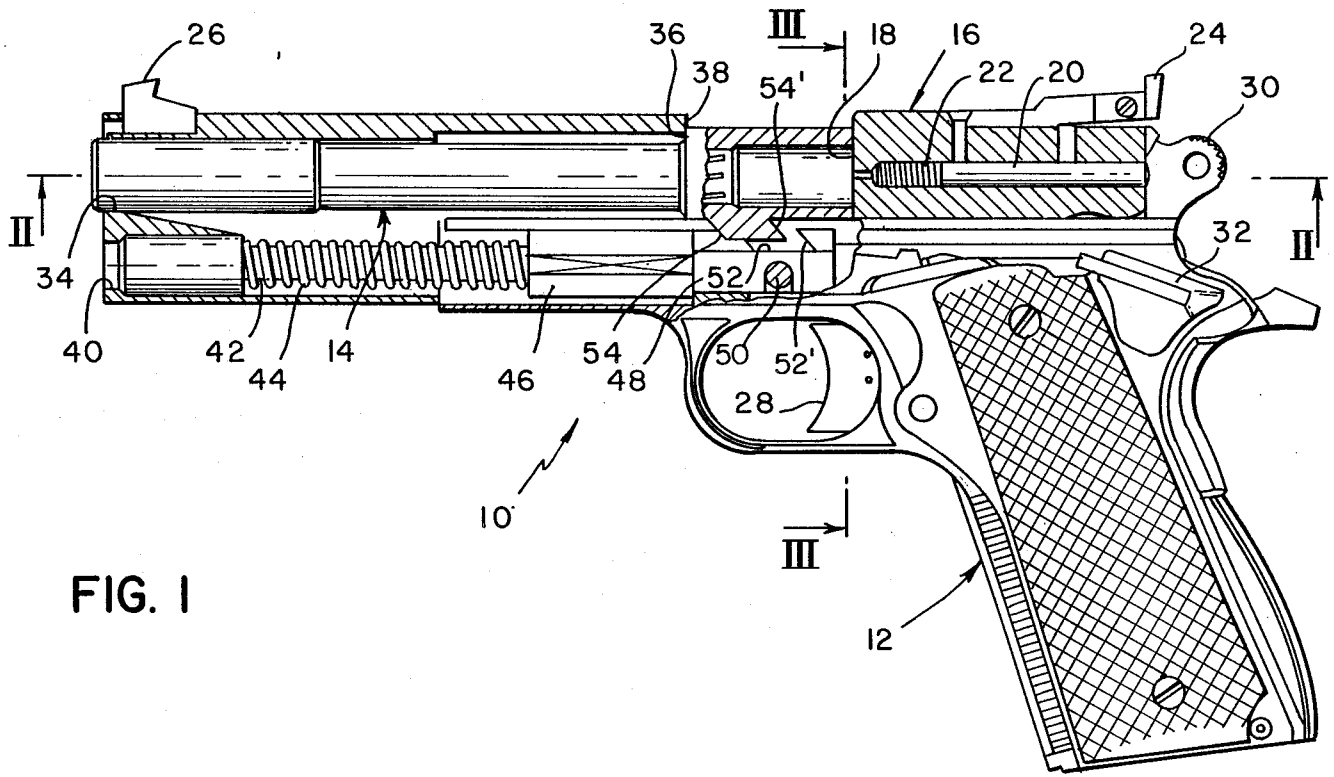
FIG. 1 illustrates a partially cut-away side view of a pistol according to the invention.

According to FIG. 1, a pistol 10 has as essential subassemblies a grip piece 12, a barrel 14 and a breech 16 which is guided shiftably longitudinally on the grip piece 12 and which by means of its front region surrounds and supports the barrel 14.

The breech 16 has a smooth concussion base 18 which, in the locking position shown in FIG. 1, closes the rear end of the barrel 14. A striking pin 20, guided so as to be longitudinally shiftable in the breech 16, is prestressed rearwards by a spring 22. A rear sight 24 and a front sight 26 are mounted on the top of the breech 16.

The grip piece 12 has a trigger lever 28, a striking lever 30 and a safety lever 32 for making the weapon safe. A magazine shaft and a tripping mechanism are arranged inside the grip piece (not shown in FIG. 1).

The barrel 14 is guided with its front end in a bore 34 of the breech 16 and, at the rear end, has an upwardly projecting shoulder 36 which engages with a locking effect behind the edge of a recess 38 in the breech. The recess 38 in the breech serves at the same time as an ejection aperture for ejecting the cartridge cases.

The breech 16, at its front end, has a further bore 40 for a spring guide rod 42 underneath the barrel 14 and forms an abutment for a closing spring 44 which surrounds the spring guide rod 42 and which prestresses the breech 16 forwards into the locking position. The closing spring 44 is supported at its rear end in a spring guide tube 46. The spring guide tube has two extensions 48 which project rearwards in a fork-like manner and which are each slipped, by means of a recess in the form of an upturned U, onto a bolt 50 extending transversely through the grip piece 12 and are anchored to the grip piece in this way.

The extensions 48 at the same time form a control piece for releasing the breech. For this purpose, the extensions 48 are each provided on their top side with a recess 52 which is limited by a ramp face 52' extending obliquely rearwards and downwards. The barrel 14, on its underside, has an extension 54 which forms a control face 54' interacting with the ramp face 52'.

When a shot is fired, the barrel 14 and the breech 16 first move back together counter to the force of the closing spring as a result of the recoil. After the projectile has left the barrel, the control face 54' slides onto the ramp face 52', thus bringing about a downward movement of the rear end of the barrel. The barrel extension equipped with the control face 54' thereby falls into the recesses in the extensions 48 of the spring guide tube 46. During the downward movement of the barrel, the shoulder 36 comes out of the recess 38, so that the breech is released and moves further back alone.

Figure 2:
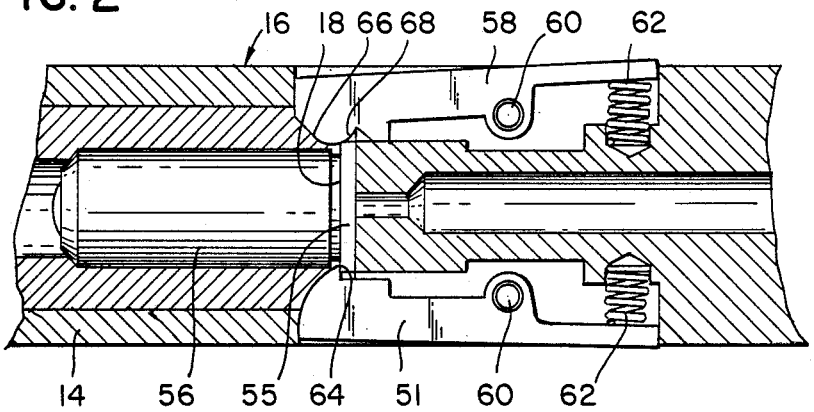
FIG. 2 illustrates an enlarged partial, section along the line II—II in FIG. 1.
Figure 3:
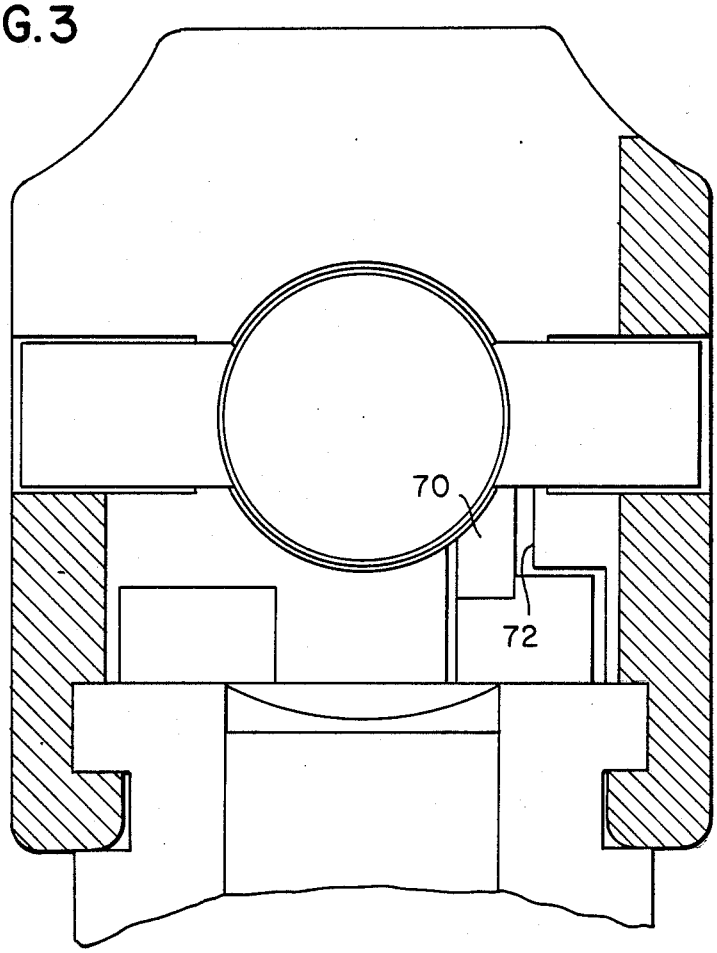
FIG. 3 illustrates an enlarged partial section along the line III—III in FIG. 1.

As can be seen from FIGS. 2 and 3, the breech 16 has a pull-out claw 51 which engages behind a cartridge base 55 of a cartridge 56 introduced into the barrel 14. Arranged on the opposite side of the breech is a holding claw 58 which supports the cartridge base 55 from the opposite side. The pull-out claw 51 and the holding claw 58 have a similar construction and are each mounted on the breech 16 pivotably by means of a hinge pin 60. The rear ends of the pull-out claw and of the holding claw are prestressed outwards by springs 62, so that the front ends of the pull-out claw and of the holding claw are pressed against the edge of the cartridge base. The front ends of the pull-out claw and of the holding claw are bevelled in a ramp-shaped manner, so that they slide over and beyond the cartridge base 55 during the closing movement of the breech 16. The pullout claw 51 has an engaging face 64 which extends approximately parallel to the concussion base 18, but is bevelled slightly in the direction of the concussion base and which comes up against the edge of the cartridge base 55 from the front and grasps this securely. By contrast, the holding claw 58 has a rounded engaging nose 66 which rests against the edge of the cartridge base 55 by means of a sloping face 68 extending obliquely forwards and inwards in relation to the cartridge base.

According to FIG. 3, arranged underneath the holding claw 58 is an ejector 70 which is fastened rigidly to the grip piece 12 and which is received by a groove 72 of the breech 16 and overlaps with the cross-section of the cartridge base 55.

When the breech 16 moves further back alone after the release, the cartridge case retained by the pull-out claw 51 and the holding claw 58 and belonging to the cartridge 56 is pulled out of the barrel 14. When the cartridge base 55 butts against the ejector 70, the nose 66 of the holding claw 58 slides off by means of the sloping face 68 on the edge of the cartridge base 55 while the pull-out claw 51, by means of its engaging face 64, retains the opposite edge of the cartridge base. The cartridge case is thus pivoted about the engaging face 64 and, during the further rearward movement of the breech, is ejected through the ejection aperture 38.

Figure 4:
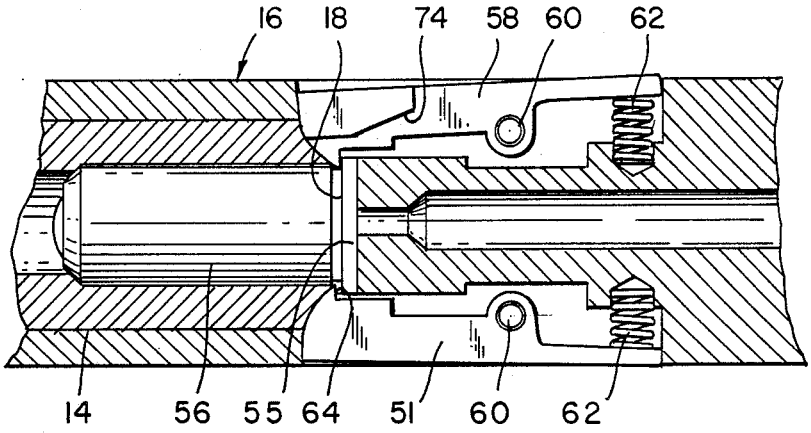
FIG. 4 illustrates a partial section similar to FIG. 2, but showing a modified embodiment of the invention.

In a modified embodiment of the invention, the holding claw 58 can be equipped with an engaging face of a form corresponding to that of the engaging face 64 of pull-out claw 51, as is shown in FIG. 4. In this case, during the ejection of the cartridge, the cartridge base is freed because the holding claw slides by means of a suitable sloping face 74 onto the ejector or onto another constructional part connected rigidly to the grip piece.

In the example illustrated, the grip piece 12 is the grip piece of a Colt pistol mentioned in the introductory part of the description. The bolt 50 normally serves for fastening the links of the Colt release system in an articulated manner.

What is claimed is:

1. A pistol comprising:

a grip piece;

barrel means for holding a cartridge;

a breech movably mounted on said grip piece for holding the barrel means and movable relative to the barrel means, the breech having a smooth concussion base;

first claw means for engaging a cartridge base;

second claw means, opposite the first claw means, for supporting the cartridge base;

an ejector cooperating with the breech; and means responsive to movement of the breech relative to the barrel, for spreading the second claw means from the cartridge base while the first claw means retains engagement of the cartridge base, thus pivoting the cartridge for ejection.

2. The pistol of claim 1 wherein the first claw means has an engaging face for engaging the cartridge base.

3. The pistol of claim 1, wherein said spreading means comprises a sloping face on the second claw means for sliding engagement with the cartridge base.

4. The pistol of claim 1, wherein the first and second claw means are resiliently urged into engagement with the cartridge base.

5. The pistol of claim 1, further including:

a bolt extending transversely through said grip piece; and means for pivoting a rear end of said barrel in response to a projectile leaving the barrel for releasing the barrel from said breech, said pivoting means including a control piece detachably connected to said grip piece by said bolt and thereby retained in the longitudinal direction of the pistol, said control piece comprising at least one recess having a ramp face for sliding engagement with a portion of said barrel for lowering the rear end of the barrel upon engagement.

6. The pistol of claim 5, including:

a barrel extension having a control face for mating engagement with said ramp face.

7. The pistol of claim 1, including:

barrel release means for lowering an end of the barrel in response to rearward movement of the breech.

8. The pistol of claim 7, wherein the release means comprises a control piece detachably connected to said grip piece and thereby retained in the longitudinal direction of the pistol, said control piece comprising a recess having a ramp face for sliding engagement with an extension of the barrel including a control face for mating engagement with said ramp face.

9. The pistol of claim 5, further comprising a bore formed in said breech to receive a spring guide rod adjacent the barrel, a closing spring surrounding the spring guide rod, said closing spring being supported in a spring guide tube having a pair of forked extensions engaged with the grip piece, wherein said forked extensions comprise said control piece.

10. The pistol of claim 3, wherein said second claw means includes an engaging face for engaging the cartridge base.

11. A pistol comprising:

a grip piece;

a bolt extending transversely through said grip piece;

a barrel having a barrel extension including a control face;

a breech movably mounted on said grip piece, said breech supporting the barrel;

means for pivoting a rear end of said barrel in response to a projectile leaving the barrel for releasing said barrel from said breech, said pivoting means including a control piece detachably connected to said grip piece by said bolt and thereby retained in the longitudinal direction of the pistol, said control piece including a ramp face for sliding engagement with said control face for forcing the rear end of the barrel downwardly upon engagement of said control face with said ramp face during recoil of the barrel; and a bore formed in said breech to receive a spring guide rod adjacent the barrel, a closing spring surrounding the spring guide rod, said closing spring being supported in a spring guide tube, and said spring guide tube being attached to said control piece, wherein said control piece comprises a pair of forked extensions attached to said spring guide tube.

12. The pistol of claim 11, wherein said ramp face comprises a forwardly and obliquely upwardly extending surface, and said control face comprises a rearwardly and downwardly extending surface.

* * * * *